US006945190B1

(12) United States Patent
Frandsen

(10) Patent No.: US 6,945,190 B1
(45) Date of Patent: Sep. 20, 2005

(54) COMBINATION SEATING AND DECKING FOR AN OPEN BOW BOAT

(76) Inventor: Jerry Frandsen, 2190 Navaho Heights, Moab, UT (US) 84572

( * ) Notice: Subject to any disclaimer, the term of this patent is extended or adjusted under 35 U.S.C. 154(b) by 0 days.

(21) Appl. No.: 10/869,373

(22) Filed: Jun. 17, 2004

(51) Int. Cl.[7] ..... B63B 17/00
(52) U.S. Cl. ..... 114/363; 114/364; 297/378.1
(58) Field of Search ..... 114/343, 362–364; 297/354.1, 378.1, 378.12, 378.13, 378.14

(56) References Cited

U.S. PATENT DOCUMENTS 3,475,773 A * 11/1969 Codman, Jr. ..... 114/361
4,567,845 A * 2/1986 Smith ..... 114/363
4,763,598 A * 8/1988 Spencer ..... 114/361
4,919,068 A * 4/1990 Lathers ..... 114/363
4,926,783 A * 5/1990 Lathers ..... 114/363
5,189,977 A * 3/1993 Davidson ..... 114/201 R
6,230,648 B1 * 5/2001 Davidson et al. ..... 114/363
6,497,192 B2 * 12/2002 Fecht ..... 114/363
6,527,341 B1 * 3/2003 Martin ..... 297/332

FOREIGN PATENT DOCUMENTS

FR 2201669 A * 5/1974 ..... B63B 03/00

* cited by examiner

*Primary Examiner*—S. Joseph Morano
*Assistant Examiner*—Ajay Vasudeva
(74) *Attorney, Agent, or Firm*—M. Reid Russell

(57) ABSTRACT

A seat back system that includes a pair of seat benches for mounting to the floor of an open bow section of a pleasure boat that each include seat backs that are individually mounted to pivot from a vertical, seat back attitude, to a horizontal attitude covering over the open bow section and includes an arrangement for pivoting the seat backs that can be hydraulic, pneumatic or mechanical, that each involve an extending piston between a boat floor and at a location along a brace that is secured to a seat back side, extending at a right angle therefrom, with piston extension to provide seat back travel, providing a load bearing deck.

8 Claims, 10 Drawing Sheets

COMBINATION SEATING AND DECKING FOR AN OPEN BOW BOAT

BACKGROUND OF THE INVENTION

1. Field of the Invention

The present invention relates to seating for an open bow pleasure boat that can be reconfigured into a deck.

2. Prior Art

Open bow pleasure boats capable of including seats for accommodating passengers in a forward or bow end of a power boat are, of course, well known. Such provide versatility in that they allow for the carrying of passengers forward of the boat operator or driver that, unless outfitted as a forward cabin, was useful only for storage. Such bow seating, however, except for carrying passengers, could only be used for unprotected storage, and is easily swamped during rough weather. To provide a cover for an open bow, operators have resorted to cutting or shaping sheet stock, such as marine plywood, to cover the open bow area, and fastening that sheet stock over the open area with a variety of fastening schemes to include screwing it is place, C-clamps, and the like. Such fastening schemes have generally been unsatisfactory in that the cover will often leak, is unattractive, and, of course, the cover has to be stored when not in use on the boat, minimizing its usefulness.

The invention is unique in that it provides fixed bench seats that have pivoting seat backs that are each movable between a vertical seat back attitude and a horizontal open bow covering attitude. Additionally, the seat backs can incorporate, respectively, an overlapping lip arrangement for sealing the junction of the seat back top or upper edges when they are in their open bow covering attitude, and provides seat back bottom edges that are moved over lip sections of edging formed around the open bow that seal with the lip sections when the seat backs is in an open bow covering attitude. Which seat backs can optionally also include sealing and locking arrangements whereby the top edges of the seat backs are maintained together, reinforcing their weight bearing capabilities with the seat back bottom edges when the seat back forward or bow ends are fitted or positioned onto open bow edging lips and lip sections. With such arrangement, the weight bearing character of the deck with the seat back top edges closed together is enhanced.

SUMMARY OF THE INVENTION

The invention is in a seat back system for use in an open bow power boat where bench seats are secured, along their lower portions, to flooring of the open bow to leave leg space therebetween, and each bench seat includes a back that is pivotally mounted to the opposite bench ends to rotate from a seat back position to where the seat back upper or top edges engage, and close together, and may, to provide load support, provide for the seat backs lower or bottom edges moving onto an edging lip that extends out from the sides of the open bow edging, where the abutting seat backs cover over the open bow as a deck.

The invention is in a movable seat back arrangement where the seat backs for bench seats mounted in an open bow of a pleasure boat serve a dual role, functioning as seat backs and are movable to a covering attitude as a deck. The seat backs each mount, at right angles, to braces that are secured to a mid-point along each seat back side, with each brace mounting a pivot at a selected point therealong that pivotally couples to the end of a rod. Which rod is a piston that extends out from of a head end of a hydraulic or pneumatic cylinder whose lower end is pivot mounted onto a boat floor of the open bow. The location of the connection point of each of the braces to the seat back side and the pivot mounting points of the rod ends to the braces and the pivot mounting of the cylinder end to the boat floor are selected to provide for travel of the seat back from their seat back attitudes to close their upper or top edges together, forming a deck. With, in which travel, the seat backs lower edges will clear an edging around the open bow, and will move into proximity with which edging when moved to the deck attitude. The seat back upper or top edges are preferably formed with overlapping outer lips or edges that fit or close together. For the deck to provide a weather covering, the abutting edges may include seals, such as a rubber seal strips, that are each fitted to one of the opposing lips or edges of the seat back upper or top edges, and where there are contacting surfaces of the open bow edging lip sections and lower of bottom seat back edges, seals may also be provided therebetween. Further, as required, a lock system may be included with the seat back whose longitudinal outer lip or edge is fitted over the other seat back outer lip or edge, that is operated by turning a handle fitted into the seat back top surface when the seat back is in its covering attitude. Which handle operation is to extend a rod out from a bow seat back side that travels into a recess formed in, or is included with, the bow edging. So arranged, the seat backs abutting seat edges are held together, further supporting a deck surface formed by the seat backs, enhancing the load bearing character of the system. Where open bow edging lip sections are employed for the seat back lower edges to rest on, they are preferably straight sections having flat top surfaces that the seat back lower edge will travel into after the seat back has been elevated to moved it into an open bow covering attitude, with the seat back leading edged lifted above to travel across, the junction of seat back top edges. Whereafter, each seat back is moved back to where the top edges align and the lower edges travel onto the open bow edging lip sections, supporting the seat backs, to provide a load bearing capability thereto.

Additional to the use of hydraulic and pneumatic operated pistons extending rods as pistons therefrom, to provide for movement of the seat backs from their vertical to horizontal to open bow covering attitudes the invention can employ a pair of electric motor screw jacks for each seat back, one on each side of each of the bench seats, that each include a lower motor coupling end for pivotal mounting the motor to the boat floor, and a rod, having a threaded upper portion, that extends out from the motor upper end. Such motors, when employed with the invention, are switched on to operate simultaneously, turning the rods threaded ends in nuts that are each mounted to a shaft that is pivotally secured to a brace and extends at a right angle outwardly from a selected location along the seat back. Additionally, for guiding seat back travel, each seat back includes a pin that extends outwardly from each seat back side, proximate to the lower edge, that is fitted to travel in a vertical guide slot secure, on one ends, to the boat floor and, preferably, to the open bowing edging on the other end. Which slot, at its open bowing edging end, includes a right angle portion that extends outwardly from the vertical end. So arranged, with the threaded rod turned in the nut that is pivotally attached to the seat back brace, the seat back pins will travel up the guide slot as the seat back is pivoted at the motor pivot mount, the seat back traveling from a vertical to horizontal attitude. In which travel, the nut allows the seat back lower edge to extend beyond an outwardly projecting lip or lip section of the open bow edging. With, at the limit of travel of the seat back, by reversing the direction of turning of the threaded rod by the motor, the seat back pin moves into the guide slot right angle portion, elevating the seat back lower edge and moves it over the lip or lip section. Simultaneously, the seat backs upper edges travel back across one another to overlap and close the seat backs top edges together, forming a deck.

For the above arrangement, as with the above described hydraulic and mechanical seat back pivoting systems, to allow for travel of which seat backs the widths and lengths, respectively, of the seats backs, and the braces are selected from the particular dimensions of the open bow area and distance from the boat floor to the deck, which measurements, along with the distances of the pivot coupling of the motors and positioning of the nuts on the brace wherethrough the threaded rods are turned provides for the required seat back travel to and from the open bow covering attitude. Further, to allow which seat back travel and provide for support of the seat back bow side, openings between lip sections of the bow edging are provide that allow the seat backs bow sides to pass therethrough and extend across the bow lip sections and come to rest thereon as the deck. With the movement of each of the seat backs from their deck attitude to their seat back arrangement, the motors turn the threaded rod in the nuts, moving the seat back pins along the right angle sections to the top of the slot, first lifting the seat back lower edges and bow side off of the lip sections and then lowering the seat back onto which lip sections. To pivot the seat backs through approximately ninety degrees, back to their seat back attitudes is accomplished by a reversal of the above motor operations and pin travel along the track segments.

It is a principal object of the present invention to provide a pair of bench seats for installation in a forward open bow section of a pleasure boat where the seats face one another and each includes a seat back that can be pivoted with the other seat back to where the seat back upper or top edges engage and hold together in a closed attitude, covering over the open bow area as a deck.

Another object of the present invention is to provide, as an arrangement for seat back pivot mounting, braces that are each secured on an end, to extend at a right angle from each side of the two seat back ends, from like selected mid-section points on each seat back side, and each brace receives a pivot end of a rod that is mounted to a selected location along the brace, with the rod fitted into, to travel in and out of a cylinder as a piston and each said cylinder is pivotally mounted to boat floor below the open bow area.

Another object or the present invention is to provide, as an additional embodiment, pairs of motors each pivot mounted to the boat floor and each turning a threaded rod in a nut secured by a pivot mounting to the side of each braces, with the threaded rod and nut functioning as a screw jack.

Another object of the present invention is to provide, the thread rod and nut screw jack arrangement where the turning of each of the two threaded rods in each nut will lift and lower the seat backs, that include pin guide arrangements, between vertical and horizontal attitudes, functioning, respectively, in the vertical attitude as the seat back and in the horizontal attitude, with the seat back top edges closed together, as an open bow area covering deck.

Another object of the present invention is to provide, by a selection of the mounting points of the braces to the seat back ends, the location of the a brace pivoting structure to each brace surface, and the selection of the cylinder or motor pivot mounting onto the boat floor, for seat back pivoting from vertical to horizontal and back to vertical attitudes where the seat back top or upper edges will engage and the lower edges with be positioned alongside of the open bow edging.

Still another object of the present invention is to provide, for use with the screw jack lifting embodiment, guide arrangements for pins extending out from each seat back side, track sections that are mounted so as to be spaced apart from and parallel to each seat back end, with the seat back sides pins each fitted to travel vertically in each track, guiding seat back travel, whereby the seat back lower or bottom end, as it is moved upwardly from vertical to horizontal attitudes, will clear an open bow edging lip and, by pin travel into a track right angle track section that faces rearwardly and thereafter, with turning of the threaded rod to lower the brace, the seat back rear edge will lower onto the open bow edging lips, and the seat back upper edges engage and overlap one another.

Still another object of the present invention is to provide a sealing arrangement between the abutting seat back edges opposing lips and between bottom or lower seat lower edges and the open bow edging lips whereon the bottom or lower seat back edge rests with the seat backs in a bow covering attitude.

Still another object of the present invention is to provide an arrangement for allowing the lower or bottom edge of each seat back to clear the open bow edging lip when moved from a vertical to horizontal open bow covering attitude and to, in turn, clear which lip when moved from its horizontal to vertical seat back attitude.

Still another object of the present invention is to provide a locking arrangement whereby a rod is fitted to slide within one of the seat backs by turning of an external handle to pass a rod end into a hole or opening formed in the open bow edging bow end, supporting the deck formed by the seat backs.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
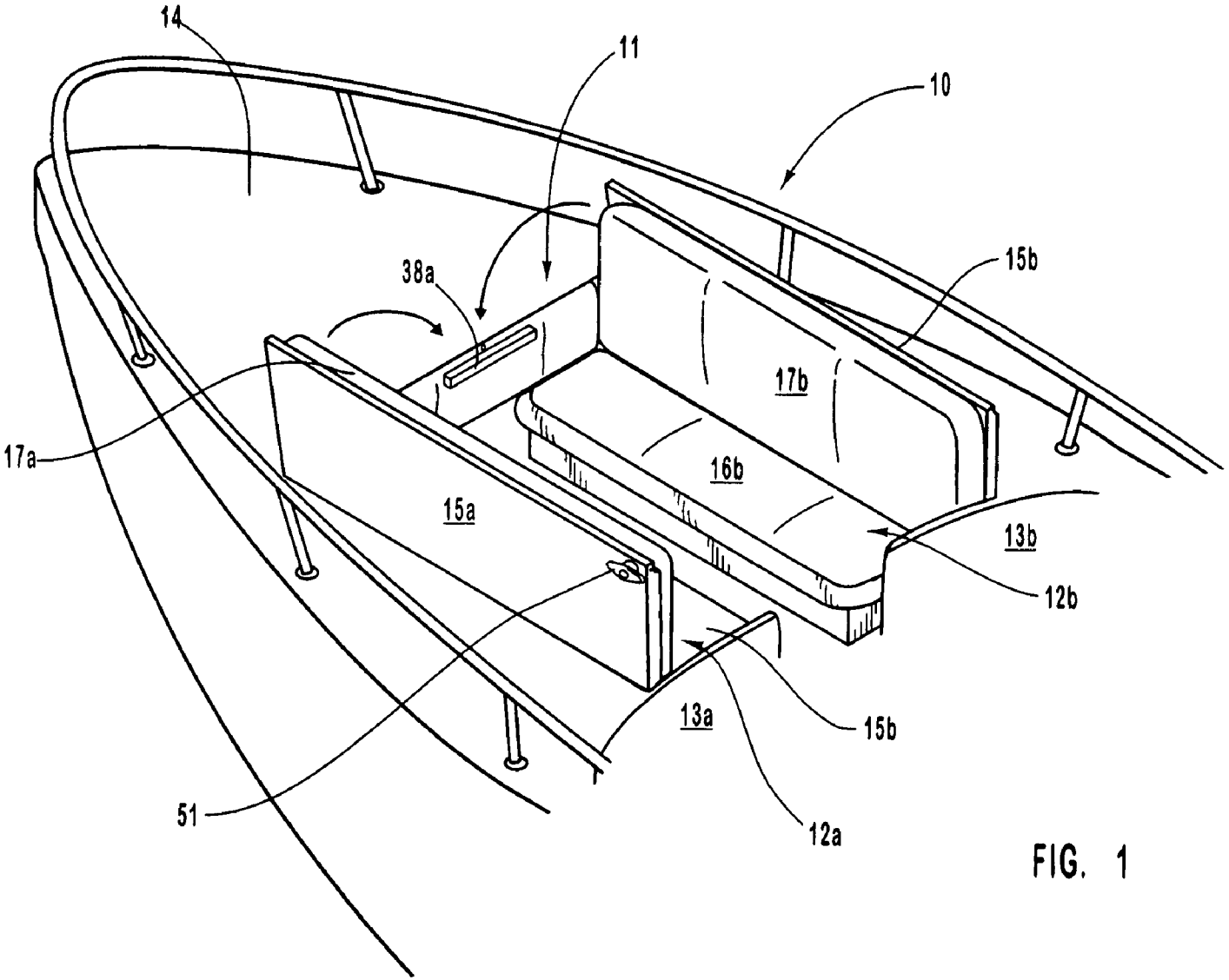
FIG. 1 is a top plan perspective view taken from above and from one side of a bow-section of a pleasure boat that is shown as having an open bow area, forward of a windscreen, wherein a pair of seats are fitted to face one another, and showing curved arrows indicating that the seat backs are capable of rotating towards one another.

The invention, as is hereinafter described, relates to pleasure boats that have open bows ahead of windscreens that allow access to that open bow area, and includes a pair of facing seats whose seat backs are movable from vertical to horizontal attitudes. In which horizontal attitudes the seat back upper or top edges at edge lips close, and preferably, overlap one another and form a deck that covers the open bow area. Which deck is shown as having, essentially, a rectangular shape but can be other appropriate shape. FIG. 1 shows a forward section of a pleasure boat 10 having an open bow area 11 wherein a pair of seats 12*a* and 12*b* are maintained, facing each other. The seats 12*a* and 12*b* are essentially alike. Accordingly, a discussion of one of the seat should be taken as a discussion of the other seat also.

Figure 2:
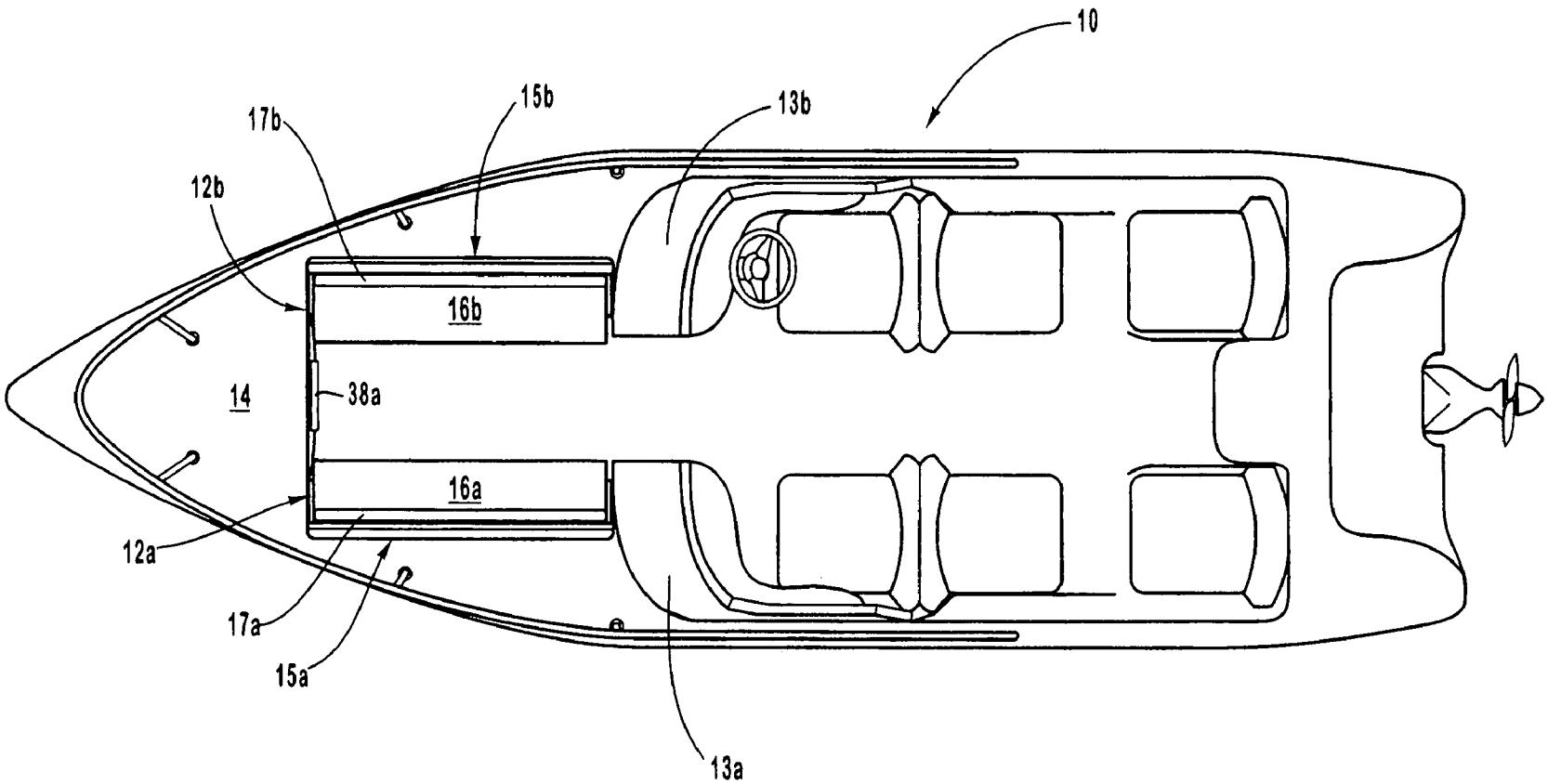
FIG. 2 shows a top plan view of the pleasure boat of FIG. 1 with seat backs shown in their upright position as seats in the open bow area as a deck.
Figure 3:
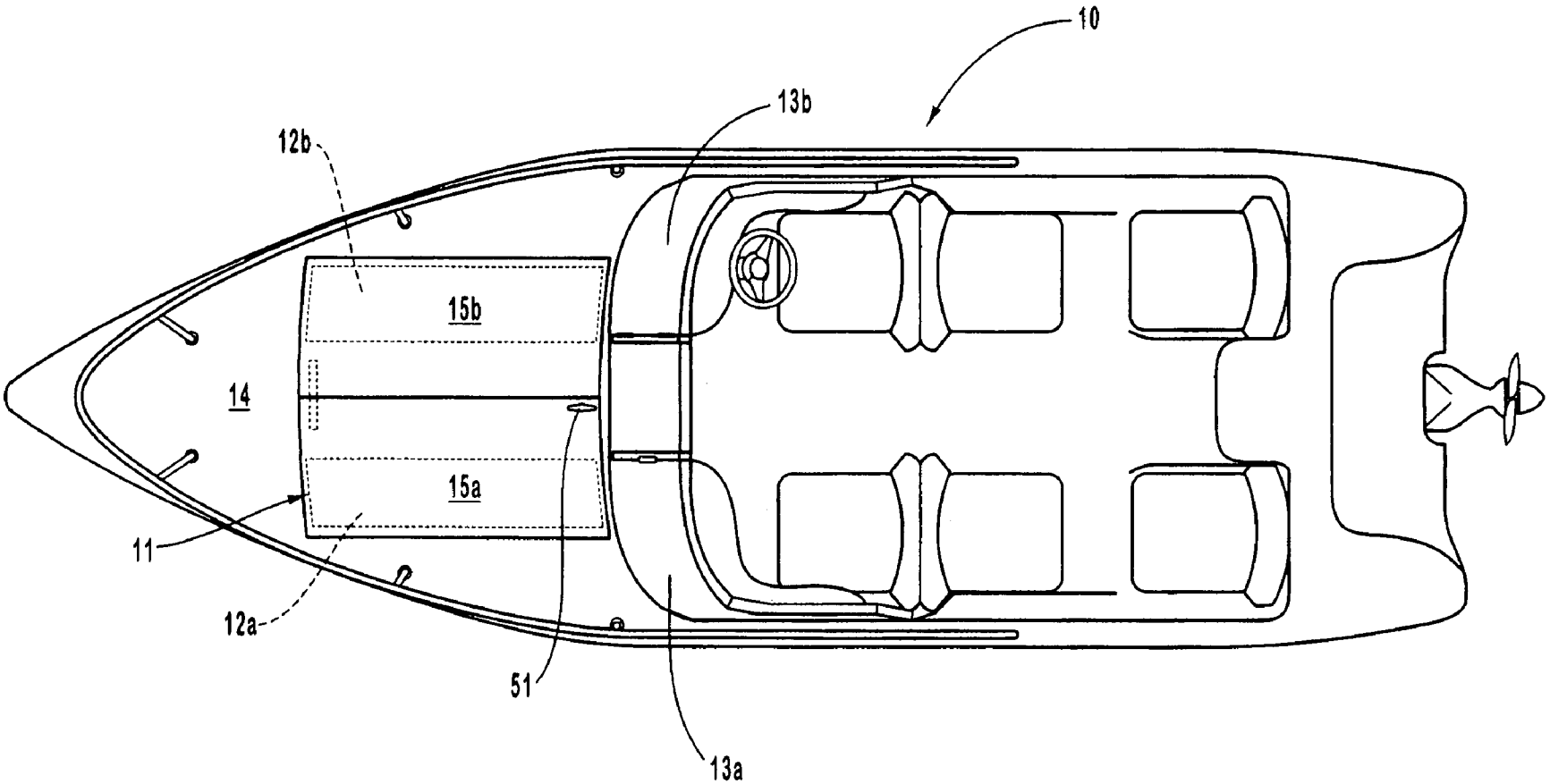
FIG. 3 is a top plan view like that of FIG. 2 only showing the seat backs as having been pivoted to their horizontal open bow covering attitude, functioning as a deck.
Figure 4:
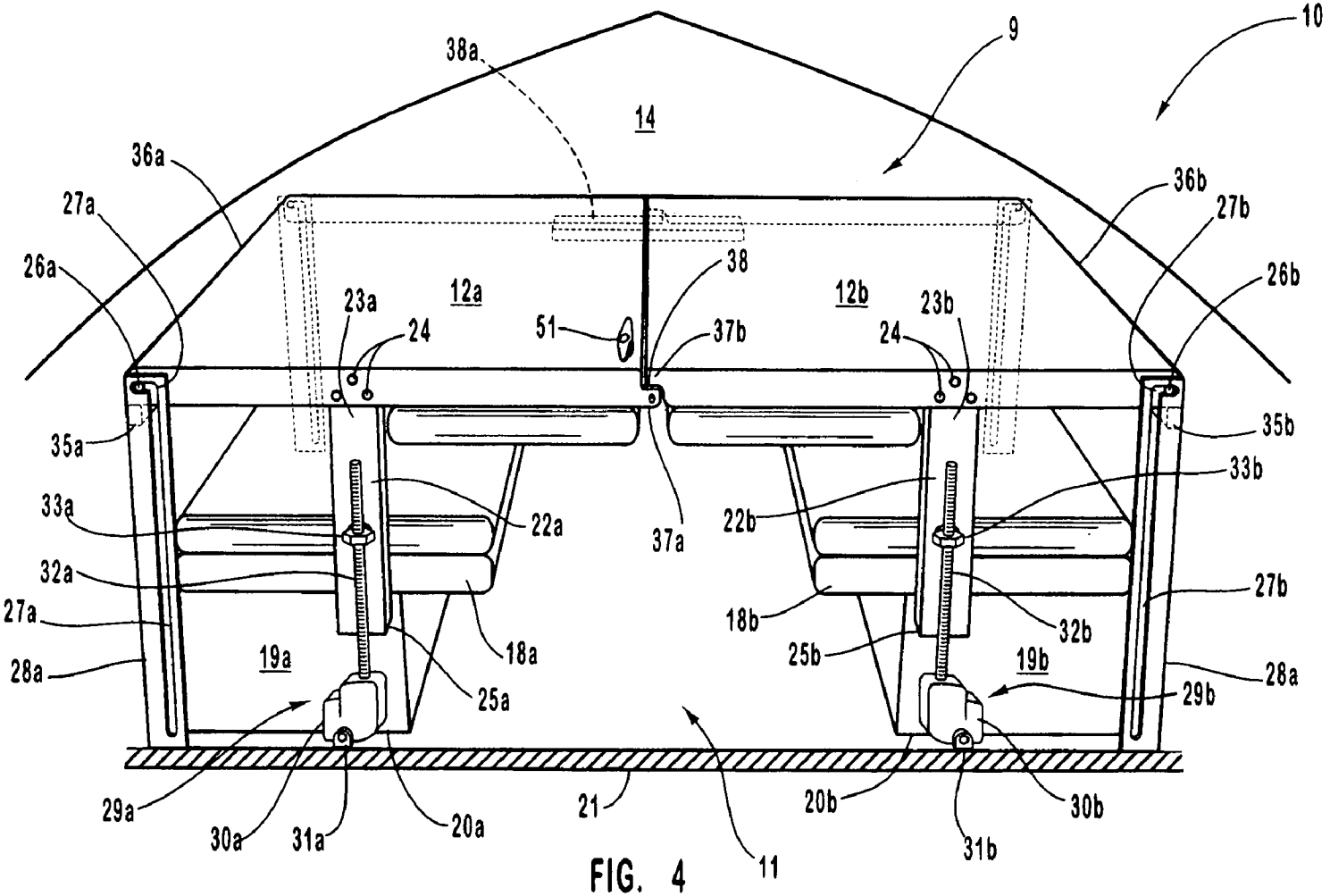
FIG. 4 is an end sectional view looking into the open bow and showing the seat backs as having each been pivoted from a seat back position to a bow open area covering attitude by operation of a each of two pairs of electric motor turning threaded screws that are turned into pivot mounted nuts mounted to, and extending outwardly from, the sides of braces, and showing the seat back's lower or bottom edges as having cleared a lip that extends outwardly from open bow edging, and showing, in solid and broken lines, guide strips having tracks therealong that are fixed to extend vertically upwardly from the boat floor to be parallel to and immediately adjacent to each seat back side, and showing pins extending from each seat back side that travel in which tracks, and showing a handle extending upwardly from the seat back deck surface that is turned to extend and retract a rod end from the seat back upper edge lip end.
Figure 5:
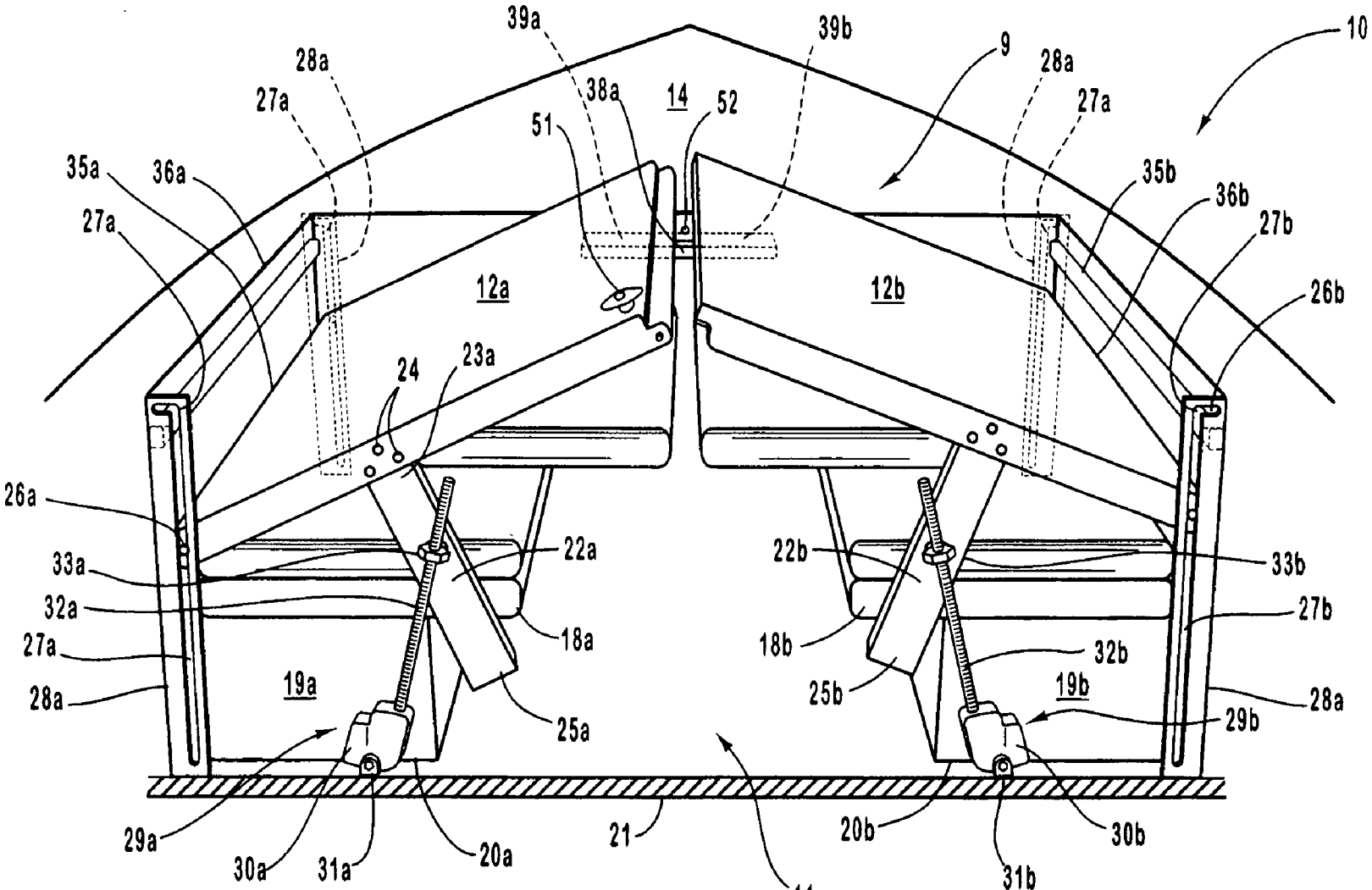
FIG. 5 is a view like that of FIG. 4 only showing the seat backs being pivoted from an open bow covering attitude back to a vertical seat back attitude by operation of the electric motors turning the threaded shafts in the pivoting nuts and show the motors as having each pivoted around their pivot mountings to the boat floor.
Figure 6:
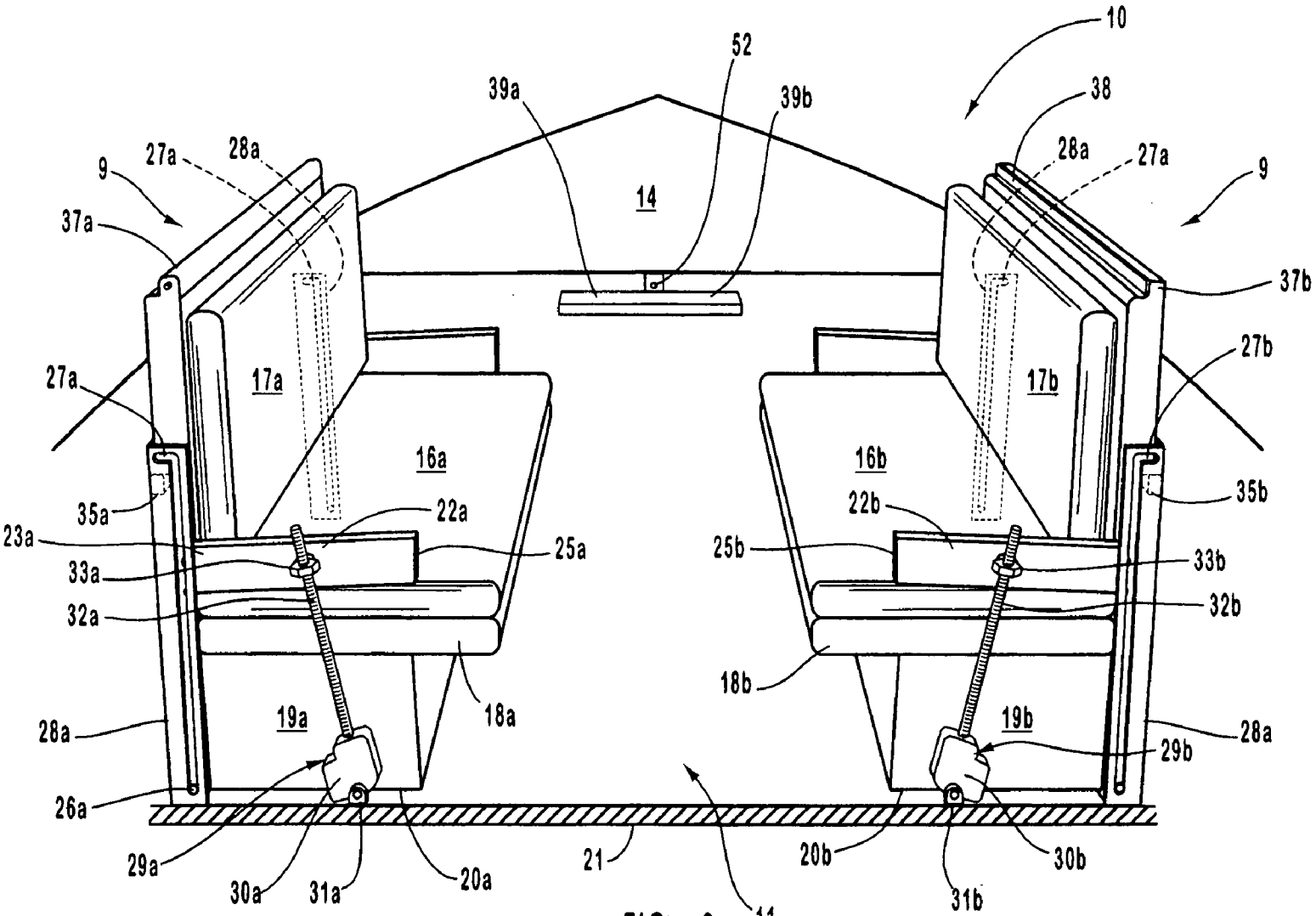
FIG. 6 is a view like that of FIG. 5 only showing the seat backs each in their vertical attitude with the threaded rods turned into the pivot mounted nut that extends outwardly from the side of the brace.
Figure 7:
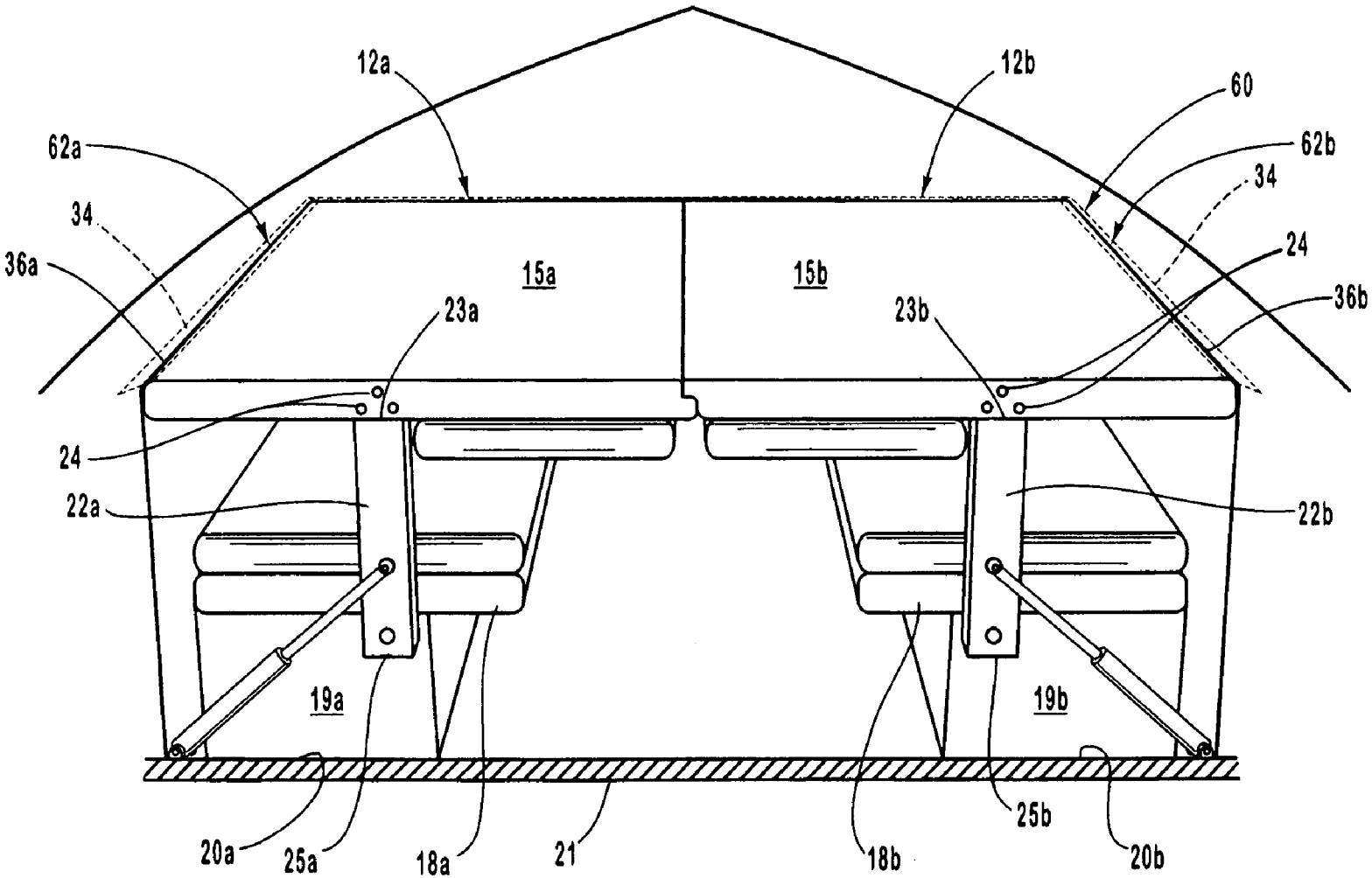
FIG. 7 is an end sectional view looking into the open bow and showing the seat back as having each been pivoted from a set back position to a bow open area covering attitude by operation of each of two pairs of hydraulic rams that have each extended a piston out from a ram cylinder top end to move an attached seat brace that is pivotally mounted at its lower end to a bench seat side, and has its top end secured, to extend at a right angle from, a seat back side, pivoting the brace and attached seat back into a deck attitude, in which pivoting the seat backs lower edges clear the open bow edging.
Figure 8:
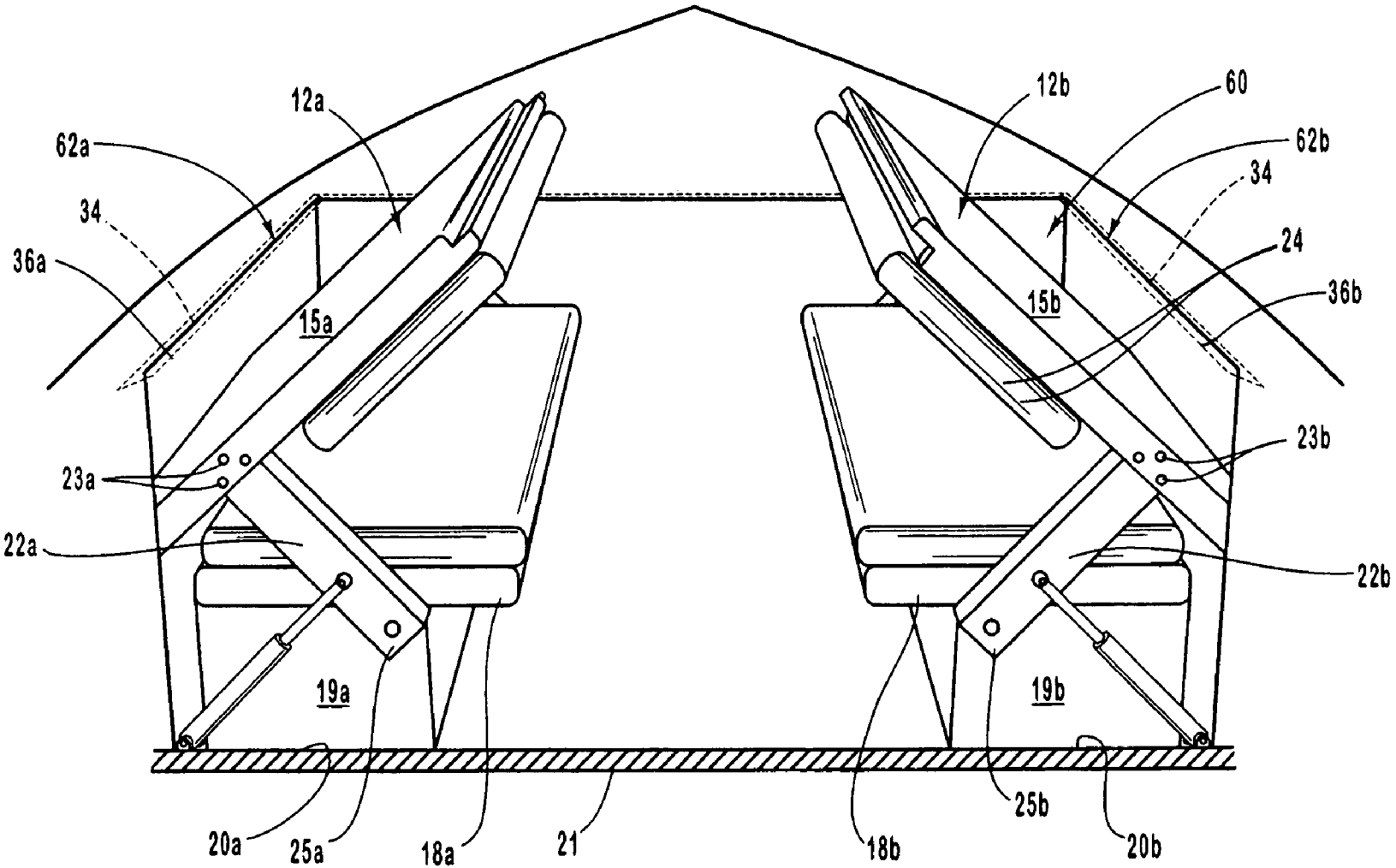
FIG. 8 is a view like that of FIG. 7 only showing the seat backs being pivoted from their deck attitude, back to a seat back attitude by operation of each of the hydraulic rams.
Figure 9:
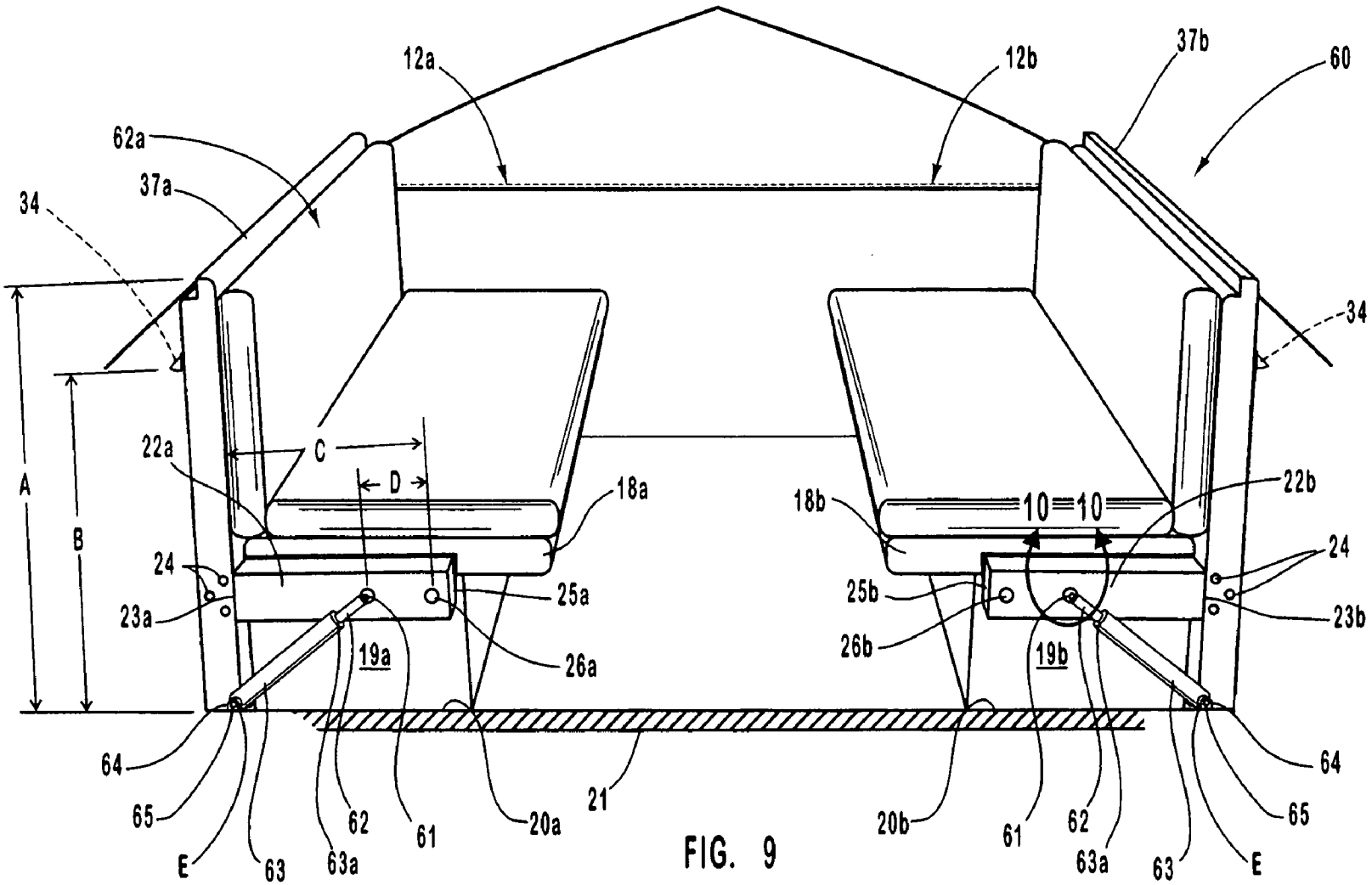
FIG. 9 is a view like that of FIG. 5 only showing the seat backs as each having been moved to their vertical attitude and with the piston rods each shown retracted into the ram cylinders.

In FIG. 1 the boat 10 is shown to include the open bow area 11 formed in a bow deck 14, wherearound an edging 34 is secured, and wherein are mounted the seats 12*a* and 12*b* that are accessible through an opening between windscreen sections 13*a* and 13*b*. FIG. 2 shows the boat 10 with backs 15*a* and 15*b* of the seats 12*a* and 12*b* in a horizontal attitude, covering the bow open area, and FIG. 3 shows the boat 10 of FIG. 2 with the seat backs 12*a* and 12*b* as having been pivoted from their horizontal attitudes to a vertical attitude, functioning as seat backs. Shown in FIGS. 1 and 3, the seat backs 12*a* and 12*b* include seat cushions 16*a* and 16*b* and seat back cushions 17*a* and 17*b* that are preferably secured to the respective flat front and top surfaces of the backs 15*a* and 15*b*, and a top surface of each of the seats are shown as seat tops 18*a* and 18*b* in FIGS. 4 through 8. FIGS. 4, 5 and 6, show a first embodiment of a seat back deck with side supports and abutting joint seals 9, with FIGS. 7, 8 and 9, showing a seat back deck embodiment 60 that does not include side supports and joint seals. Which seat tops 18*a* and 18*b* are each secured onto a rectangular box shaped seat base having stern sides 19*a* and 19*b* that, it should be understood, are like the bow sides, not shown, and which sides 19*a* and 19*b* are, in turn, mounted, along base edges of each 20*a* and 20*b*, to a boat floor 21 of the open bow area 11.

Each seat back 12*a* and 12*b* includes a pair of straight braces 22*a* and 22*b*, respectively, that are individually secured to the seat back sides, at the braces top end 23*a* or 23*b*, as with bolts 24, to extend at a right angle from the undersurface at mid-point along the ends of the seat back, as shown in FIGS. 4 through 8. FIGS. 4, 5 and 6 show the opposite pairs of brace ends 25*a* and 25*b*, respectively, as floating in FIGS. 4, 5 and 6, to pass along the seat sides 19*a* and 19*b* allowing the seat back to swing from a vertical seat back position to a horizontal attitude, extending over, and essentially parallel to, the bench it is attached to, with the two seat back functioning as a deck over the open bow. Whereas, the seat back deck embodiment 60 of FIGS. 7, 8 and 9 show the brace ends 25*a* and 25*b* as pivotally mounted to operate with a hydraulic or pneumatic ram to provide for seat back pivoting, and the deck formed by the seat backs, as shown in FIG. 7, lacks side support and edge weather sealing, as well as edge support at the open bow edging, and lacks a support locking arrangement as are included with the seat back deck embodiment 9 of FIGS. 4, 5 and 6.

In the seat back deck embodiment 9, of FIGS. 4, 5 and 6, to provide for seat back 12*a* and 12*b* pivoting, each seat includes a pair of motors 29*a* and 29*b*, that each include a housing 30*a* and 30*b* whose bases are mounted at pivots 31*a* and 31*b* to the boat floor 21. The pivots 31*a* and 31*b* on each seat 19*a* and 19*b* end allow the motors 29*a* and 29*b* to swing with travel of the braces 22*a* and 22*b*. The swinging of which brackets 22*a* and 22*b* moves each seat backs 12*a* and 12*b* through approximately ninety degrees from a horizontal, open bow covering attitude, to a vertical attitude, as shown in FIGS. 4 through 6. To provide which braces 22*a* and 22*b* swing, the motor 29*a* and 29*b* each have rods 32*a* and 32*b* with threaded upper portions extending from their top or head ends that are turned by operation of each motor, and each rod 32*a* and 32*b* threaded upper portion is turned into a nut 33*a* or 33*b* that are each pivotally maintained on a shaft that is secured to each bracket 22*a* and 22*b*, extending at right angles outwardly from each bracket surface. Turning of the rods 32*a* and 32*b* threaded upper portions in the nuts 33*a* and 33*b* raises or lowers the nuts and connected braces 22*a* and 22*b*, moving the connected seat backs 12*a* and 12*b*. Which seat backs 12*a* and 12*b* each include a pin 26*a* or 26*b* extending out from the seat back side, just above its lower edge 36*a* and 36*b*. Whereby, in seat back movement, the pins 26*a* and 26*b* are guided along one of vertical track sections 28*a* of track segments 27*a*. At the top limit of pin travel in a vertical track section 28*a*, as shown in FIG. 4, each pin is moved into a right angle track section 27*b*. Accordingly, each of the rods 32*a* and 32*b* turned in a nut 23*a* or 23*b*, by operation of each motor 29*a* and 29*b*, function like a screw jack, elevating or lowering each brace 22*a* and 22*b*. Which brace elevation and lowering moves the seat backs 12*a* and 12*b* between their attitudes shown in FIGS. 4 through 6. With, near a top limit of travel of the nuts 33*a* and 33*b* the pins 26*a* and 26*b* will be at the top of the vertical track section 27*a* of each of the identical track segments 28*a*, and the seat back 12*a* and 12*b* lower ends 36*a* and 36*b* will have passed lips 35*a* and 35*b*, shown in solid lines in FIG. 5 and broken lines in FIG. 6, that extend outwardly from the open bow edging. Whereat, with further turning of each rod 32*a* threaded upper portion in nut 33*a*, the pins 26*a* and 26*b* will travel along to the end of the right angle track sections 27*b*, urging the seat backs 12*a* and 12*b* lower ends 36*a* and 36*b* back over the lips 35*a* and 35*b*. Which lips 35*a* and 35*b* then support the seat back lower ends 36*a* and 36*b* resting thereon, as shown in FIG. 4. Which pins 26*a* and 26*b* travel, it should be understood, are coordinated by a synchronized turning of the motors 29*a* and 29*b*, with, at the limit of pin travel along the right angle track sections 27*a*, upon a reversing of the direction of turning of the rods 32*a* and 32*b* upper threaded portions in the nuts 33*a* and 33*b*, the seat backs 12*a* and 12*b* lower ends 36*a* and 36*b* will first be lifted off the lips 35*a* and 35*b* and the seat backs top or upper ends lips 37*a* and 37*b* are separated by elevating the upper end lip 37*b* off of the lower end lip 37*a*, separating them. Whereafter, with further reverse turning of the rods, the seat back lower edges 36*a* and 36*b* will pass end lips 35*a* and 35*b*, shown in broken lines in FIG. 4 and in FIG. 5. Further reverse turning of the rods 32*a* and 32*b* causes the seat back lower ends to lower and pass beneath the lips 35*a* and 35*b*, with the pins 26*a* and 26*b* guided along the vertical track sections 27*a* to the seat back attitude of FIG. 6.

Proper seat back 12*a* and 12*b* rotation is provided by the above set synchronized motors 29*a* and 29*b* turning the rods 32*a* and 32*b* in the respective nuts 33*a* and 33*b* that are mounted at selected locations on, to extend outwardly from, the respective braces 22*a* and 22*b*. Proper rotation is also governed by a selection of the lengths and spacing distances the braces are mounted to the sides of the seat backs 12*a* and 12*b*; the location of the motors 29*a* and 29*b* pivot mountings 31*a* and 31*b* to the boat floor 21; as well as the arrangement of the track segments 28*a* that each have the vertical track section 27*a* wherein the pins 26*a* are fitted to travel. With the above items properly located, the seat back lower edges 35*a* and 35*b*, respectively, will clear the open bow edging lips 35*a* and 35*b* and then the seat back lower edges will travel back over which lips 35*a* and 35*b*. In which seat back travel, the pins 26*a* travel from the tops of the vertical track sections 27*a* and into right angle track sections 27*b*, causing the seat back upper edges 37*a* and 37*b* to close together. In which closure, the edge lip 37*b* fits over the edge lip 37*a*. Which seat back upper edges 37*a* and 37*b* preferably include a sealing strip 38 fitted onto one the opposing upper edges 37*a* and 37*b*, that proves a sealed closure, as shown in FIGS. 4, 5 and 6, between the opposing edges 37*a* and 37*b* surfaces. The two edges 37*a* and 37*b* thereby compress or sandwich the sealing strip 38, as shown best in FIG. 4.

To facilitate the movement of the seat backs 12*a* and 12*b* from their vertical attitudes, as shown in FIG. 6, to their covering attitude shown in FIG. 4, where the seat back top edges and bow sides fit snugly on the open area edging lips 37*a*, and 37*b*, sandwiching the seal strip 38 therebetween, it is necessary for the seat back upper edges to move past their closure location at the longitudinal center of the deck. In which movement, the seat back lower edges must clear the open bow edging lips 39*a* and 39*b*. Thereafter, the seat backs are moved back to where their lower edges travel onto which open bow edging lips 39*a* and 39*b*, with the seat backs passing alongside the open bow edging 36*b*, and the seat back upper edges closing together to where the edge lip 37*b* fits over the edge lip 37*a*, sandwiching the seal 38 therebetween. The motors 29*a* and 29*b* are synchronized to operate together, extending and retracting the rods 32*a* and 32*b* the same distances out from and into the tops of which motors, thereby moving the seat backs 12*a* and 12*b* identically from the seat back open bow covering attitudes and return to their seat back attitudes. Which motors 29*a* and 29*b* operations are preferably controlled by a single conventional electrical switch, not shown. The motors 29*a* and 29*b* preferably include limit switches, not shown, for discontinuing motor turning at limits of seat back travel.

With the seat backs 12*a* and 12*b* in the attitude shown in FIG. 4, where the seat back lower edges 36*a* and 36*b* rest on the open bow edge lips 35*a* and 35*b*, and the seat back bow ends rests on bow lip sections 39*a* and 39*b*, shown in solid lines in FIG. 6 and broken lines in FIG. 4, a load applied onto the seat backs in their deck attitude is transmitted through the braces 22*a* and 22*b*, and nuts 33*a* and 33*b* into the rods 32*a* and 32*b*. Which load is thereby passed through motors 29*a* and 29*b*, through their pivot couplings 31*a* and 31*b* and into the boat floor 21. Additionally, to increase load bearing strength, the invention can further include a locking system 50 that includes a handle 51 that is journaled in one of the seat backs deck surface, as shown in FIG. 4, and is connected to a rod extension mechanism, not shown, such as one that is commonly for use with cabinet doors. So arranged, a turning of the handle will extend rod ends 51, with a bow rod end, not shown, extending out of the seat back 12*a* side to travel into a hole 52, shown in FIG. 6, that is formed into the open bow edge, adjacent to the bow lip sections 39*a* and 39*b*. So arranged, the junction of the overlapping seat back top edge lips is reinforced to strengthen the load bearing capabilities of the seat backs in their attitude shown in FIG. 4.

Figure 10:
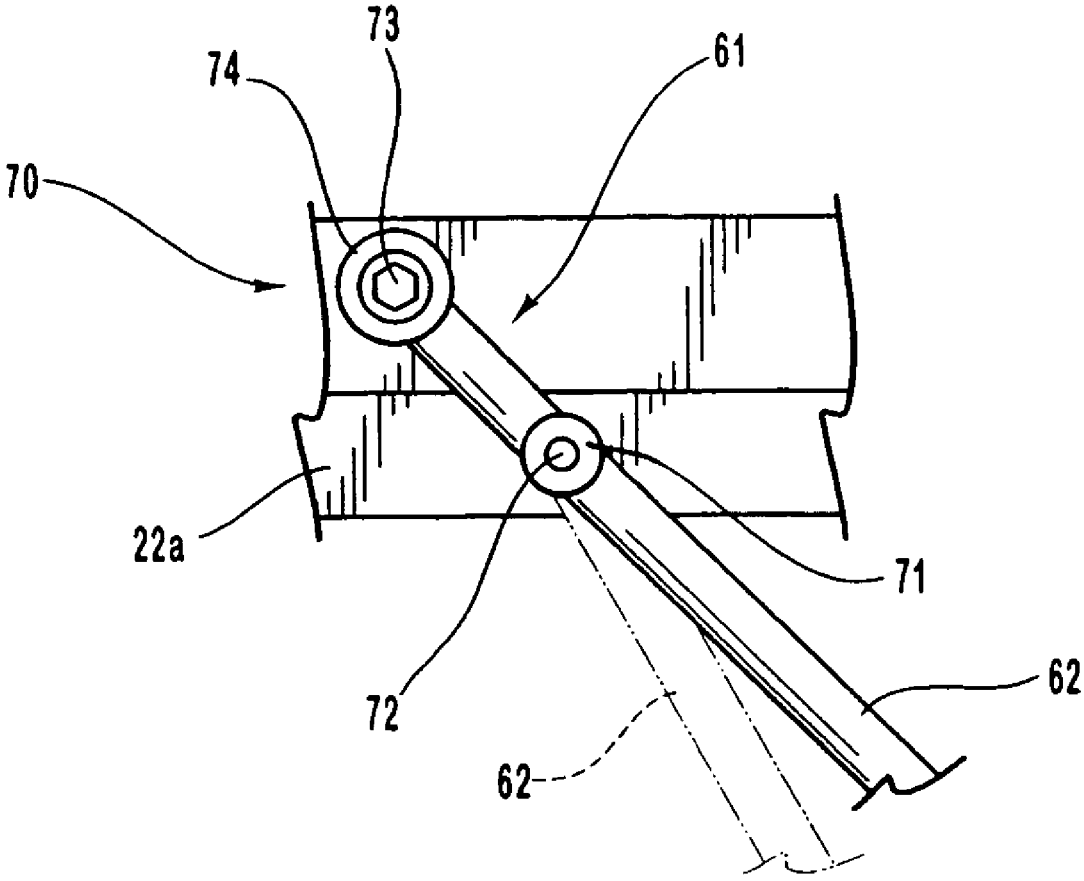
FIG. 10 is an enlarged sectional view taken within the line 10—10 of FIG. 9, showing the pivot as an eccentric pivot that pivotally couples the ram piston top end to the side of the brace.

The seat back deck embodiment 60, as shown in FIGS. 7 through 9, is like the seat back deck embodiment 9, as set out above, in that it to includes; seat backs 12*a* and 12*b*; rectangular box seats each having a top 18*a* and 18*b* and sides 19*a* and 19*b*, with the sides mounted along base or bottom edges to a boat floor; and with braces 22*a* and 22*b* secured by bolts 24 at their ends 23*a* and 23*b* to the ends to the seat backs 12*a* and 12*b*, extending at right angles outwardly therefrom. Unlike the seat back deck embodiment 9, the braces 22*a* and 22*b* ends 25*a* and 25*b* are each pivotally mounted to the seat sides 19*a* and 19*b*, respectively, by pivots 26*a* and 26*b*. The braces 22*a* and 22*b* and connected seat backs 12*a* and 12*b*, in the seat back deck embodiment 60, are pivoted around the pivots 26*a* and 26*b* in their travel from their seat back attitude of FIG. 9 to their deck attitude of FIG. 7. With the braces and connected seat backs each traveling through an arc of approximately ninety degrees. In which seat back travel it is necessary for the seat back lower edges 36*a* and 36*b* to clear the open bow edging 34, shown in broken lines in FIG. 7 and fit closely alongside of which open bow edging 34 in a deck attitude, as shown in FIG. 7. In which deck attitude the seat backs 12*a* and 12*b* upper lip edges 37*a* and 37*b* will butt together in overlapping arrangement. Which seat back travel and positioning as a deck, as shown in FIG. 9, is provided for a length of brace 22*a* appropriate to pivot the seat back through approximately ninety degree, by a selection of a distance C between the mounting point of the brace 22*a* mounting to the seat back by connectors 24 and the distance D between a pivot coupling 61 to the pivot coupling 26*a* or 26*b* on the side of brace 22*a*. Which pivot coupling 61 is secured to the end of a piston rod 62 that extends out from a top 63*a* of a cylinder 63 whose lower end 64 is pivotally coupled at 65 to the boat floor 21 at a selected location E. Accordingly, for a distance B from the boat floor 21*a* width A of set back 12*a* and 12*b* is selected and, therefrom the location of pivot 26*a* or 26*b* onto the sides of braces 23*a* and 23*b* is selected, as the location of the pivot 61 on the end of piston rod 62, and the location of the pivot 65 end of the cylinder 63 mounting to the boat floor 21. In practice, a height B to the open bow edging 34 is approximately forty four percent of the open bow width, with, for the seat backs 12*a* and 12*b* to clear which edging when pivoted, the seat back has a width A is approximately fifty percent of the open bow width, that is the "cut out" for the seating arrangement. With a selection of the distances A and B, and from their relationship, a distance C of the pivot 61 to the brace end coupling to the seat back side is approximately twenty two percent of the open bow width. After the determination of the distance C, the distance D is determined by trial and error, and the pivot point mounting E of the cylinder end 65 to the floor 21 is selected to be approximately aligned with a corner of the seat back lower edge and forward face of the seat back 12*a* or 12*b*. So arranged, the seat back 12*a* or 12*b* lower edge 36*a* or 36*b* will clear the open bow edging 34 when the seat back is pivoted from the attitudes shown in FIG. 7 to FIG. 9. In practice, for the seat back lower edge 36*a* or 36*b* to clear the open bow edging 34, the seat back will not close tightly against the open bow edging in the attitude shown in FIG. 7. To provide for a closer fit between the edges 36*a* and 36*b* and edging 34, the pivots 26*a* and 26*b* can, within the scope of this disclosure, be an eccentric pivot 61, as shown in the enlarged sectional view of FIG. 10 for use with all the braces 22*a* and 22*b*. FIG. 10 shows the eccentric pivot 70 as including a disk 74 that is center mounted by a fastener 73 onto the side of brace 22*b* that is, of course, mounted by pivot 26*b* onto the side 19*b* of the bench seat. The disk 74, as shown, connects through a rod to a second pivot 72 mounted into the brace 22*a* and is journaled to an end 71 of rod 62, that causes rod 62 displacement, as shown in broken lines, upon rod extension, moving the seat back rearwardly through the brace 22*a*. So arranged, as illustrated in the solid and broken line representations of the piston rod 62, when the piston rod is extended to its limit of outward travel the disk 74 and pivot 73 will have also traveled to its limit of outward travel, moving the seat back upper edge 37*a* slightly past its junction with the other seat back upper edge, and the seat back lower edge 36*a* or 36*b* will have traveled past and is slightly above the open bow edging 34. Which open bow edging 34 can, as needed, employ a lip, not shown, like the lip 35*a* or 35*b* of the seat back deck embodiment 9, as set out above, to receive the seat back lower edge 36*a* or 36*b* moved thereon when the ram piston 61 is pulled back into the cylinder 63, pulling the disk 74 and pivot 73 therewith displacing the rod 62 and shown in broken lines. In which lug movement, the seat back is moved back towards the open bow edging 34, closing the gap therebetween, moving the seat backs to their attitude shown in FIG. 7.

Hereinabove has been set out a description of a preferred embodiments of combination of seating and decking system for an open bow boat showing movable seat backs and an arrangement for moving the seat backs into a deck covering attitude, providing load bearing deck. It should also be understood the invention can be applied to a number of open bow boat configurations by a selection of component lengths. Accordingly, it should be understood that the present invention can be varied within the scope of this disclosure without departing from the subject matter coming within the scope of the following claims, and a reasonable equivalency thereof, which claims I regard as my invention.

I claim:

1. An open bow boat decking system consisting of a pair of bench seats for mounting in an open bow area of a pleasure boat that each have like movable seat backs that can be erected into a deck, covering over that open bow area comprising, a pair of rectangular benches each having a bottom surface that is secured onto a floor of said open bow area and seat backs that face one another and having forward and stern ends that align; a pair of rectangular seat backs that each include a straight brace secured at a right angle to each said seat back side at a selected distance therealong; a fastener means pivotally mounted to an outer surface of said brace that receives a rod fitted thereto such that rod outward and inward travel moves the fastener means and connected brace, and means for moving said rod outwardly and inwardly to move also each said seat back from its vertical to deck covering horizontal attitude and back to its vertical attitude; and means for guiding travel of said seat backs through approximately ninety degrees upon extension and retraction of said rod.

2. An open bow boat decking system as recited in claim 1, wherein the fastener means is a pivot mounting of the rod end; and an end portion of said brace is pivotally mounted to the side of the seat bench.

3. The open bow boat decking system as recited in claim 1, wherein the fastener means is a nut means that is pivotally mounted to extend at a right angle outwardly from the brace and the rod includes a threaded upper portion for turning in said nut means and said rod is fitted to extend outwardly from a top of each of two pairs of motor means that each axially turn one of said rods, and each said motor means is pivotally connected, at a motor means lower end, to a floor of the pleasure boat open bow area, alongside one of said bench ends, whereby, with synchronized turning of said pairs of said rods by each said motor means in each said nut means, each brace is pivoted and moves each said seat back from its vertical to deck covering horizontal attitude and back to its vertical attitude; and a guide means mounted to said pleasure boat floor, alongside each said seat back side, that includes a vertical track that a pin that extends at a right angle outwardly from said seat back side, adjacent to said seat back top edge, travels in.

4. The open bow boat decking system as recited in claim 3, wherein guide means is a flat straight rectangular section that is connected at its lower end to the boat floor to extend vertically, alongside and parallel to a seat back side, that includes a straight vertical slot formed from proximate to a lower end to proximate to an upper end of said flat rectangular section, and a right angle slot intersects an upper end of said straight vertical slot projecting away from said seat back rear surface.

5. The open bow boat decking system as recited in claim 1, wherein the seat backs are flat rectangular sections and each includes a straight lower edge for positioning alongside of edging of an open bow, and said seat backs upper edges each include an edge lip extending therefrom with the one said lip to overlap and fit snugly onto the other seat back upper edge lip.

6. The open bow boat decking system as recited in claim 5, wherein a strip of sealing material is maintained to one of the two opposing edge lip surfaces to sandwich between said edge lips contacting surfaces.

7. The open bow boat decking system as recited in claim 1, wherein the width of each seat back, length of each brace, a location of the mounting point of an end of said brace to said seat back, the location of the fastener means to the surface of said brace, and the location of a pivotal mounting and the means for moving the rod in or out to the boat floor are selected to allow said seat back to rotate from a vertical attitude to a horizontal attitude with each of said seat backs lower edges clearing and coming to rest proximate to the open bow edging, and to allow said seat back upper edges to contact one another.

8. The open bow boat decking system as recited in claim 1, further including a locking system for maintaining the abutting seat backs upper edges in an overlapping arrangement that includes a straight rod fitted to slide in one seat back proximate and parallel to said seat back upper edge, extending from a adjacent to a stern end to open at a bow end; a handle pivotally mounted in said seat back that is connected through a pivot to said straight rod such that, when said handle is turned, the rod end will extend outward from the seat back bow end, and said rod end is to travel into a hole formed in a bow portion of the open bow edging.

* * * * *